United States Patent [19]

Healey

[11] Patent Number: 4,800,597

[45] Date of Patent: Jan. 31, 1989

[54] DECONTAMINATION SHELTER

[76] Inventor: Brian J. Healey, 21 Harvard St., Charlestown, Mass. 02129

[21] Appl. No.: 196,788

[22] Filed: May 18, 1988

Related U.S. Application Data

[63] Continuation of Ser. No. 024,914, Mar. 11, 1987, abandoned, which is a continuation of Ser. No. 746,721, Jun. 20, 1985, abandoned.

[51] Int. Cl.[4] ..... A47K 3/22

[52] U.S. Cl. ..... 4/599; 52/33; 52/791; 135/97; 600/21

[58] Field of Search ..... 4/596, 597, 599, 663, 4/600, 612, 614; 52/79.1, 79.7, 79.8, 33; 135/97; 128/1 R

[56] References Cited

U.S. PATENT DOCUMENTS

| | | | |
|---|---|---|---|
| 932,909 | 8/1909 | Saunders | 135/97 |
| 2,247,340 | 6/1941 | Webster | 52/403 X |
| 2,828,757 | 4/1958 | Thaxton | 135/97 |
| 2,841,832 | 7/1958 | Couse et al. | 52/79.8 X |
| 3,345,996 | 10/1967 | Sadove et al. | 128/1 R |
| 3,391,409 | 7/1968 | Gatley | 4/599 X |
| 3,439,966 | 4/1969 | Perkins et al. | 128/1 R X |
| 3,501,213 | 3/1970 | Trexler | 128/1 R X |
| 3,629,875 | 12/1971 | Dow et al. | 4/599 |
| 3,955,328 | 5/1976 | Lindsay | 52/79.8 X |
| 4,348,777 | 9/1982 | Peterson | 4/596 |
| 4,675,923 | 6/1987 | Ashley | 4/599 |

FOREIGN PATENT DOCUMENTS

| | | | |
|---|---|---|---|
| 1128274 | 1/1957 | France | 135/97 |

*Primary Examiner*—Charles E. Phillips

[57] ABSTRACT

A decontamination shelter with compartments arranged in adjacency with traversal enclosures therebetween defined by the walls of the adjacent compartments and openings in the adjacent walls provided with closures which, when closed, provide isolation corridors between compartments and wherein the openings and closures therefor provide for passage from one compartment to the next through the isolation corridors.

4 Claims, 1 Drawing Sheet

DECONTAMINATION SHELTER

This is a continuation of co-pending application Ser. No. 024,914 filed on Mar. 11, 1987 and now abandoned, which is a continuation of Ser. No. 746,721, filed June 20, 1985, both now abandoned.

BACKGROUND OF THE INVENTION

Decontamination shelters partitioned to provide a succession of compartments for disrobing in order to remove contaminated clothing, showering to rinse off any contaminant and redressing are known. Openings provided with closures are provided between compartments to permit passage from one compartment to the next. Such structure has the disadvantage that as a worker proceeds from one compartment to the next, there is direct communication between compartments so that the contaminants can flow through from one compartment to the next unimpeded and, in addition, movement of the worker from one compartment to the next displaces the contaminants from one compartment to the next. It is the purpose of this invention to provide a decontaminant shelter wherein there are locks or dead spaces between compartments which may be secured to prevent direct transfer of contaminants from compartment to compartment during the progress of the worker from one compartment to the next, thus to provide maximum security against transfer of contaminants from the contaminated area into the shower area and from thence into the dressing area.

SUMMARY OF THE INVENTION

As herein illustrated, the invention relates to a decontamination shelter comprising compartments arranged in adjacency with corridors defining locks or dead spaces therebetween formed in part by the confronting walls of the adjacent compartments containing openings providing with closures which, when closed, isolate the corridors from the compartments. The openings and closures therefor are offset laterally relative to each other and provide for passage from one compartment to the next through the intervening corridors. The corridors are further defined by extensions of the top, bottom and side walls of the compartments between compartments. The compartments comprise in succession a disrobing area for removing contaminated clothing, a showering area for washing off the decontaminant and a dressing area. There is a shower facility supported in the compartment constituting the shower area. The closures are provided with closure fasteners, for example, zipper fasteners. The shelter desirably is comprised of flexible waterproof material and scaffolding in the form of hollow tubes with connecting fittings which can be erected to support the shelter and easily dismantled when the shelter has served its purpose.

The invention will now be described in greater detail with reference to the accompanying drawings, wherein.

Figure 1:
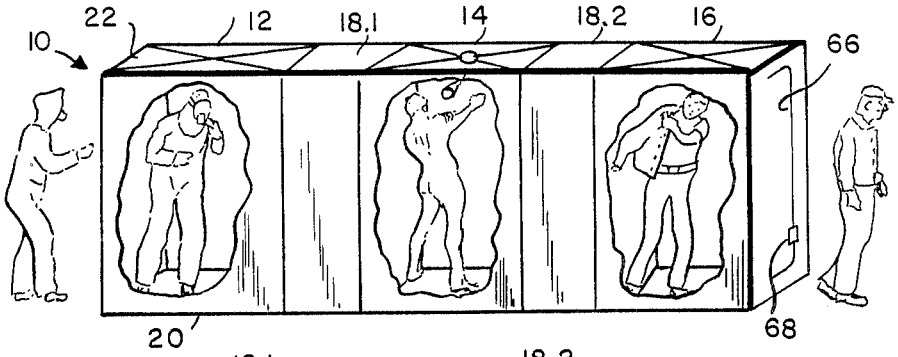
FIG. 1 is a perspective of the shelter broken away in part.

Referring to the drawings, there is shown in perspective, FIG. 1, a decontamination shelter 10 comprising three compartments 12, 14 and 16 arranged in adjacency with locks or corridors 18.1 and 18.2 between adjacent compartments.

Figure 2:
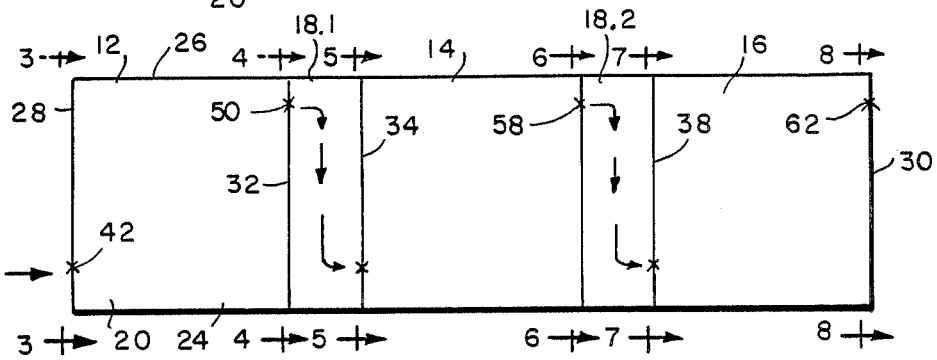
FIG. 2 is a top plan view diagrammatically illustrating the corridors between compartments.
Figure 3:
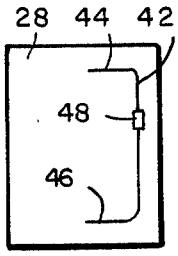
FIG. 3 is a vertical section taken on the line 3—3 of FIG. 2.
Figure 4:
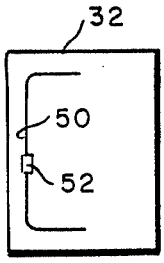
FIG. 4 is a vertical section taken on the line 4—4 of FIG. 2.
Figure 5:
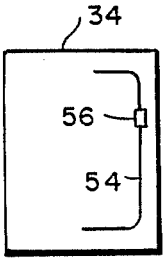
FIG. 5 is a vertical section taken on the line 5—5 of FIG. 2.
Figure 6:
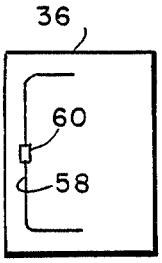
FIG. 6 is a vertical section taken on the line 6—6 of FIG. 2.
Figure 7:
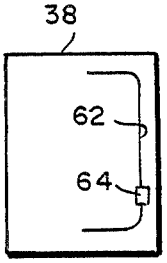
FIG. 7 is a vertical section taken on the line 7—7 of FIG. 2.
Figure 8:
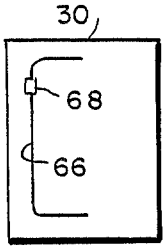
FIG. 8 is a vertical section taken on the line 8—8 of FIG. 2.
Figure 9:
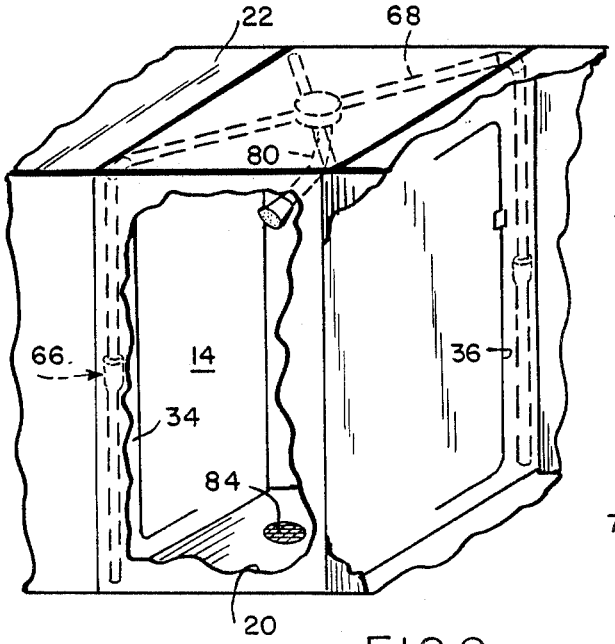
FIG. 9 is a perspective of a portion of the shelter with supporting scaffolding, broken away in part to show the shower and drain.

The shelter is comprised of a cover of flexible waterproof material and is rectangular in vertical and horizontal section comprising FIG. 1, a bottom wall 20 which constitutes a floor, a top wall 22 which constitutes the roof and, FIG. 2, spaced, parallel side walls 24 and 26, spaced, parallel end walls 28 and 30 and spaced, parallel partitions 32, 34, 36 and 38, these latter partitions dividing the interior of the shelter into the respective compartments 12, 14 and 16 and the corridors 18.1 and 18.2. The end wall 28, FIG. 4, contains a vertical opening 42, the upper and lowr ends 44 and 46 of which are radiused to define a closure flap which permits the opening to be expanded to allow entrance into the compartment 12. A closure in the form of a zipper fastener 48 is provided for securing the closure flaps. As illustrated, the opening 42 is located adjacent the right-hand side of the shelter 54. The partition 32, FIG. 4, contains a similar opening 50 and zipper fastener 52 located adjacent the opposite side of the shelter. This latter opening provides access from the compartment 12 to the corridor 18.1. The partition 34, FIG. 5, contains an opening 54 and zipper closure 56 adjacent the one side in laterally-spaced relation to the opening 50 which provides access from the corridor 18.1 to the compartment 14. The partition 36 contains an opening 58 and zipper closure 60 is located at the opposite side laterally displaced with respect to the opening 54 which provides access from the compartment 14 to the corridor 18.2. The partition 38 contains an opening 62 and zipper closure 64 at the one side laterally of the opening 58 which provides access from the corridor 18.2 to the compartment 16. The end wall 30 contains an opening 66 and zipper closure 68 which provides for leaving the compartment 16 and shelter. Desirably, the corridors are approximately 18 inches wide.

The shelter is designed to be erected in an area which is contaminated to provide for entrance of a worker into the contaminated area and, after he has finished his job, to leave the area free of contaminant. When going from outside to the contaminated area, the worker enters the compartment 16, removes his street clothing and dons clothing suitable for the job at hand, whereupon he proceeds successively from the entrance compartment 16 through the corridor 18.2, shower area 14, corridor 18.1 and compartment 12 into the contaminated area where work is to be performed. As he moves from compartment to compartment through the isolation corridors 18.2, 18.1, he successively opens and closes the closures so that security is maintained between compartments. After he has completed his work in the contaminated area, he opens the closure 42, enters the compartment 12, closes the closure 42, removes his clothing, opens the closure 52, enters the corridor 18.1, closes the closure 52, opens the closure 56, enters the compartment 14, closes the closure 56 and takes a shower. Following this, he opens the closure 60, moves into the corridor 18.2, closes the closure 60, opens the closure 64 and enters the compartment 16 when he dons his clothes. He then opens the closure 60 and leaves through the opening 58.

Throughout the exit from the contaminated area from compartment to compartment and through the intervening corridors, the compartments are isolated from each other, thus insuring a minimal transfer of contaminated material from the contaminated area through the compartments to the place of exit either by natural air flow or by body displacement.

Figure 10:
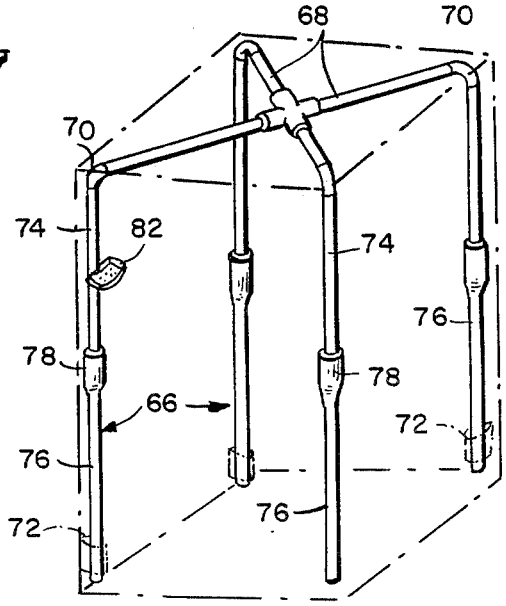
FIG. 10 is a perspective of the scaffolding.

As previously mentioned, the shelter is comprised of a flexible material, for example, vinyl, and is supported by scaffolding. As shown in FIG. 10, the scaffolding is comprised of vertical supports 66 in the form of tubular metal posts, arranged quadrilaterally at a spacing corresponding to the width and length of the compartments. The upper ends of the supports 66 are connected by diagonal tubes 68 connected to the upper ends of the supports 64 by suitable couplings 70. The lower ends of the supports 66 are received within sockets 72 secured to the inner sides of the walls. Desirably, the supports 66 are made up of upper and lower tubular sections 74 and 76, the lower sections being provided with enlarged upper ends 78 for receiving the lower end of the upper section 74, thus making it possible to easily erect the shelter for use and after it has been used, to dismantle it.

A shower head 80 or its equivalent is fastened to the diagonal tubes 68 at their intersection and suitable receptacles 82 may be mounted to one or more of the supports 66 within the compartment 14 for holding soap, sponges and the like. The floor of the compartment 14 is desirably provided with an opening 84 through which shower water can be drained. A pump, not shown, may be used to evacuate the water.

Additionally, the supports 66 in the compartment 12 may be provided with hangers for contaminated clothes removed and the supports 66 in the compartment 16 may be provided with hangers for street clothes.

The shelter as thus described provides for safe access and egress from the contaminated area, can be easily transported to the place of use, erected for use and dismantled when the work is completed and is desirably comprised of materials which are inexpensive and expendable. It is to be understood that the shelter in its multi-chamber form can be used for other purposes than hazardous waste.

It should be understood that the present disclosure is for the purpose of illustration only and includes all modifications or improvements which fall within the scope of the appended claims.

What is claimed is:

1. A portable shelter of rectangular, vertical and horizontal section comprising in line three longitudinally-spaced support frames and a cover removably disposed on the frames, said frames each comprising vertical supports in the form of quadrilaterally arranged posts and horizontal supports joining the upper ends of the posts and said cover comprising a flexible sheet material embodying a top, a bottom, spaced, parallel sides and spaced, parallel ends, said cover further comprising longitudinally-spaced, tranversely-disposed pairs of spaced, parallel, flexible sheet material partitions disposed transversely of the spaced, parallel sides, with each pair disposed between adjacent frames such as to divide the structure into three isolation compartments with isolation corridors therebetween, comprising a first compartment within which contaminated clothing can be removed, a second compartment containing a shower head at the top and a drain at the bottom within which contaminant can be washed off and a third compartment within which uncontaminated clothing can be donned and said corridors providing space for moving from one compartment to another and said partitions embodying transversely-spaced flaps such as to require traversing the corridors from one side to and exit from the other to move from one compartment to another and said end walls embodying flaps for entrance into the structure.

2. A decontamination shelter according to claim 1 wherein the flaps are provided with zipper fasteners.

3. A decontamination shelter according to claim 1 wherein the distance between the transversely-disposed, parallel partitions of the pairs of partitions is approximately 18 inches.

4. A decontamination shelter according to claim 1 wherein said support frames comprise four standing corner posts connected at their upper ends by diagonals.

* * * * *

UNITED STATES PATENT AND TRADEMARK OFFICE

CERTIFICATE OF CORRECTION

PATENT NO. : 4,800,597

DATED : January 31, 1989

INVENTOR(S) : Brian J. Healey

It is certified that error appears in the above-identified patent and that said Letters Patent is hereby corrected as shown below:

Title page:

[73] Assignee: California Products Corporation
Cambridge, Massachusetts 02139

Signed and Sealed this

Thirty-first Day of October, 1989

*Attest:*

*Attesting Officer*

DONALD J. QUIGG

*Commissioner of Patents and Trademarks*